US007270710B2

(12) United States Patent
Yamaguchi

(10) Patent No.: US 7,270,710 B2
(45) Date of Patent: Sep. 18, 2007

(54) TABLE FREE GLUING DEVICE

(76) Inventor: Haruko Yamaguchi, Room 104, 5-23-10 Yakuendai, Funabashi-shi, Chiba (JP) 274-0077

( * ) Notice: Subject to any disclaimer, the term of this patent is extended or adjusted under 35 U.S.C. 154(b) by 220 days.

(21) Appl. No.: 11/074,282

(22) Filed: Mar. 6, 2005

(65) Prior Publication Data

US 2005/0199347 A1 Sep. 15, 2005

(30) Foreign Application Priority Data

Mar. 12, 2004 (JP) ..... 2004-114795

(51) Int. Cl.
*B05C 17/10* (2006.01)
*B65C 9/22* (2006.01)
*B05D 1/26* (2006.01)

(52) U.S. Cl. ..... 118/241; 118/242; 118/256; 427/207.1; 156/575; 156/578; 156/579

(58) Field of Classification Search ..... 118/241, 118/242, 256; 401/48; 427/207.1; 156/575, 156/578, 579

See application file for complete search history.

(56) References Cited

U.S. PATENT DOCUMENTS 5,605,572 A * 2/1997 Berger ..... 118/241

* cited by examiner

*Primary Examiner*—Laura Edwards

(57) ABSTRACT

A table free gluing device having a glue container includes a gluing part attached by a lid, an upper handle to install the glue container, a plate to hold the glue container cooperating with the upper handle, a lower handle to hold paper cooperating with the upper handle, a joint to connect the upper handle, the plate and the lower handle, two pairs of upper rollers with belts installed on the plate and two pairs of lower rollers with belts installed on the lower handle to grip and roll paper firmly and smoothly cooperating each other, a window cooperating with rails to adjust glue pressure mounted on the upper handle, a spring to press glue container cooperating with the upper handle and the lower handle, and to push back the upper handle, marks on the upper handle to indicate the position of the gluing part.

14 Claims, 3 Drawing Sheets

TABLE FREE GLUING DEVICE

FIELD OF SAID INVENTION

Said present invention generally relates to a stationery of gluing device.

BACKGROUND OF SAID INVENTION

Gluing device usually requires a table and paper under paper to glue. However, it is a disadvantage of known gluing device that requires supplementary tools in order to glue paper. Moreover, said supplementary tools have a tendency of becoming dirty and sticky as unnecessary glue is transferred, which is not suitable for large volume of gluing work.

SUMMARY OF SAID INVENTION

It is one object of said present invention to provide a gluing device which does not require any supplementary tools to glue paper.

It is another object of said invention to provide a gluing device which frees hand from becoming dirty and sticky.

With said above and other objects in view said invention provides a table free gluing device comprising a glue container includes a gluing part attached by a lid, an upper handle to install said glue container, a plate to hold said glue container cooperating with said upper handle, a lower handle to hold paper cooperating with said upper handle, a joint to connect said upper handle, said plate and said lower handle, two pairs of upper rollers with belts installed on said plate and two pairs of lower rollers with belts installed on said lower handle to grip and roll paper firmly and smoothly cooperating each other, a window cooperating with rails to adjust glue pressure mounted on said upper handle, a spring to press glue container cooperating with said upper handle and said lower handle, and to push back said upper handle, marks on said upper handle to indicate said position of said gluing part.

BRIEF DESCRIPTION OF SAID DRAWINGS

Said invention will now be described by way of example with reference to said accompanying drawings in which.

DETAILED DESCRIPTION OF SAID PREFERRED EMBODIMENT

Figure 3:
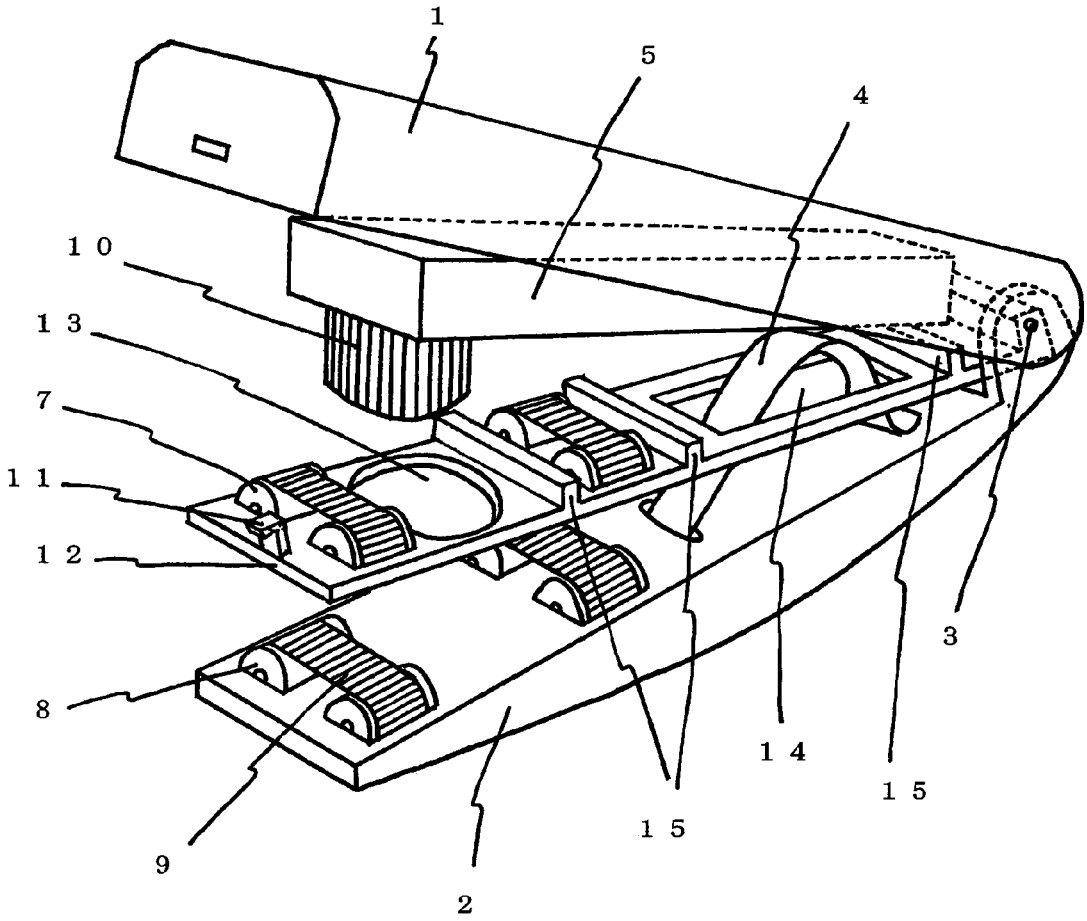
FIG. 3 shows a perspective view of said invention opening said plate.

Referring to FIG. 3, a glue container 5 made by soft vessel such like vinyl or soft plastic filled with liquid type glue including a gluing part 6 arranged on said side of said glue container 5 is placed inside of an upper handle 1 and held by a plate 12 and locked by a clasp 11. The glue container 5 is set in upper handle 1 which the plate 12 is fixed and irremovable. The glue container 5 contains liquid, solid, or gel glue.

Said gluing part 6 is set in a glue holding hole 13. A lid 10 such as screw cap type is employed on to said gluing part 6 to prevent liquid type glue from drying up.

Four upper rollers 7 are distributed, one roller being on each corner of said glue holding hole 13 on said plate 12.

Each two upper rollers 7 are jointed together by a belt 9 made from said material such like rubber so as to grip paper firmly.

Four lower rollers 8 are distributed in said position to corresponding to said upper rollers 7.

Each two lower rollers 8 are jointed together by said belt 9. Upper and lower belts are removable.

A thin plate shaped spring (coil type) 4 is set on said lower handle 2.

Several holding parts 15 are set on upper side of said plate 12 to rest and hold said glue container 5 and to prevent said glue container 5 from touching said upper rollers 7 and belt 9.

Also a hole for spring 4 is set on said plate 12 cooperating to said spring 4 to push said body of said glue container 5.

Figure 2:
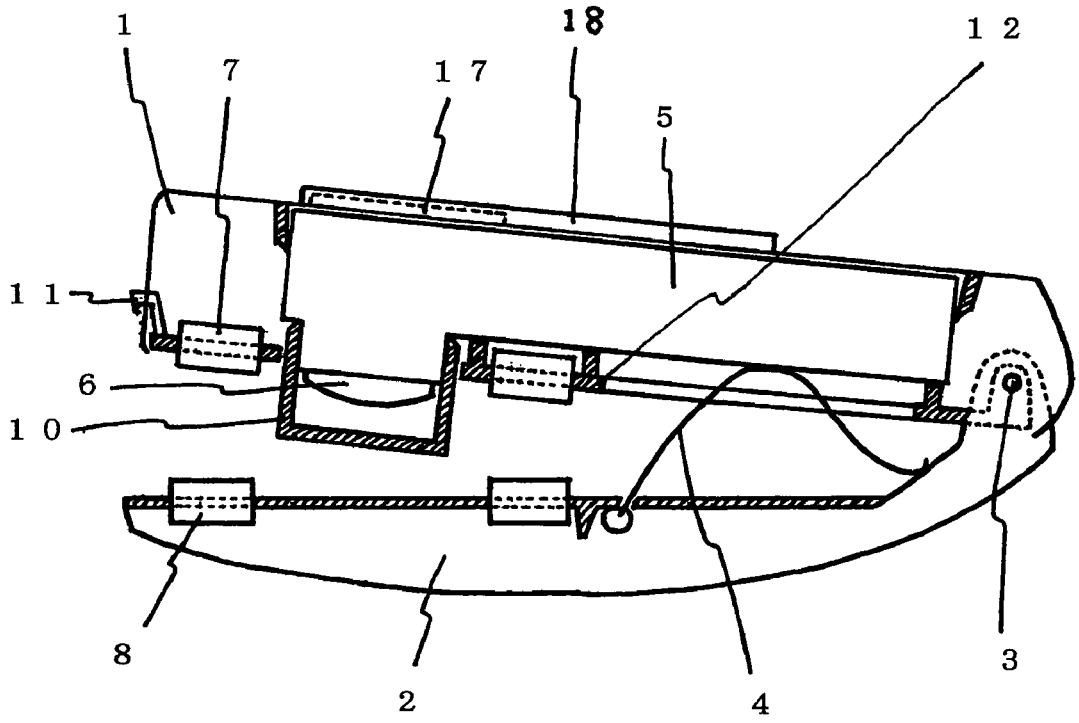
FIG. 2 shows a side view of said invention partially cut away.

Referring to FIG. 2, a window 17 adjusting gluing pressure and a set of rails 18 are mounted on said upper handle 1.

Figure 4:
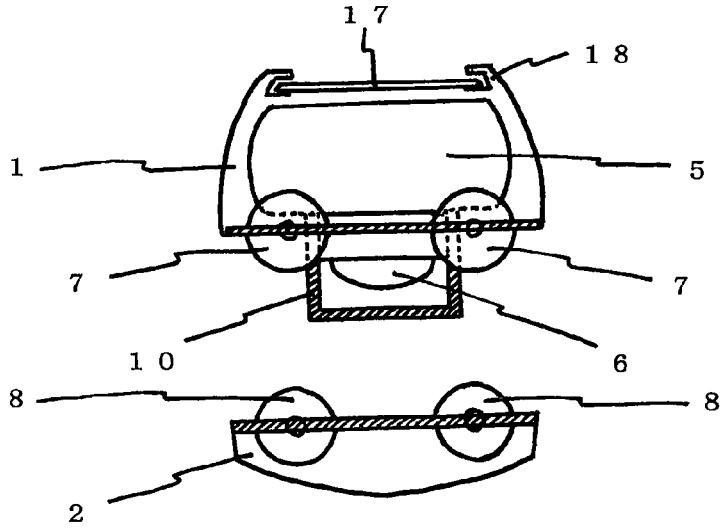
FIG. 4 shows a front view of said invention.
Figure 5:
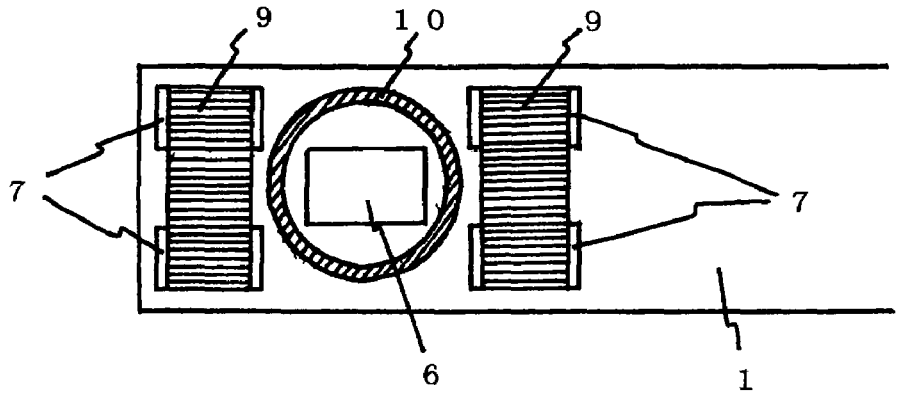
FIG. 5 shows a view of upper rollers on said upper handle.
Figure 6:
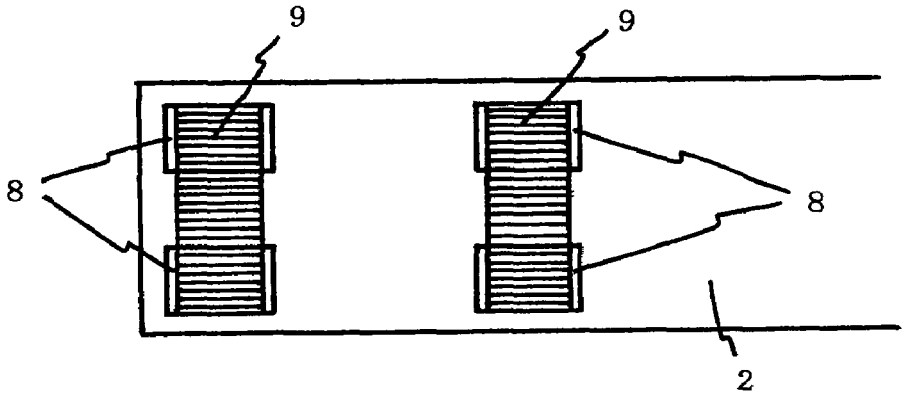
FIG. 6 shows a view of lower rollers on said lower handle.

FIG. 4 is showing example of said rails 18 and window 17 sliding in different angles. The sliding window 17 and rails 18 are set inside of the upper handle 1. The window 17 can also be opened by a hinge without rails 18.

Said upper handle 1, plate 12 and lower handle are connected together with a joint 3.

Figure 7:
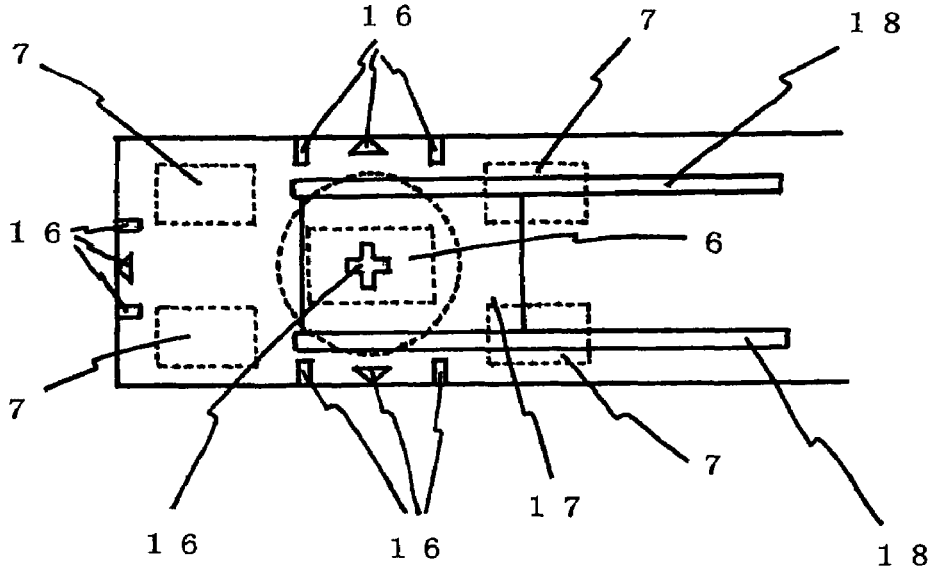
FIG. 7 shows an example how marks are placed on top of said upper handle.

Referring to FIG. 7, said marks 16 are placed on top of said upper handle 1 showing said position of gluing part.

Setting said position where to start gluing by said marks 16, holding and pushing said upper handle 1 and lower handle 2 together to hold paper by said upper rollers 7 and lower rollers 8.

Then start gluing by sliding said invention as rollers guide and move and stop gluing by stop sliding said invention and said upper and lower handles come apart to an original position by relaxing hand power given to said upper and lower handles by said action of spring 4.

Although said spring 4 helps said liquid glue coming out by pushing said glue container 5, a gluing pressure can be adjusted by pressing said glue container 5 by finger directly through said window 17 when said gluing pressure is not enough to push out glue.

Said invention employs said lid 10 on to said gluing part to prevent liquid type glue from drying up when it is not used.

Also, said invention is kept upside down so that said gluing part 6 faces up to prevent said liquid glue from leaking down.

Figure 1:
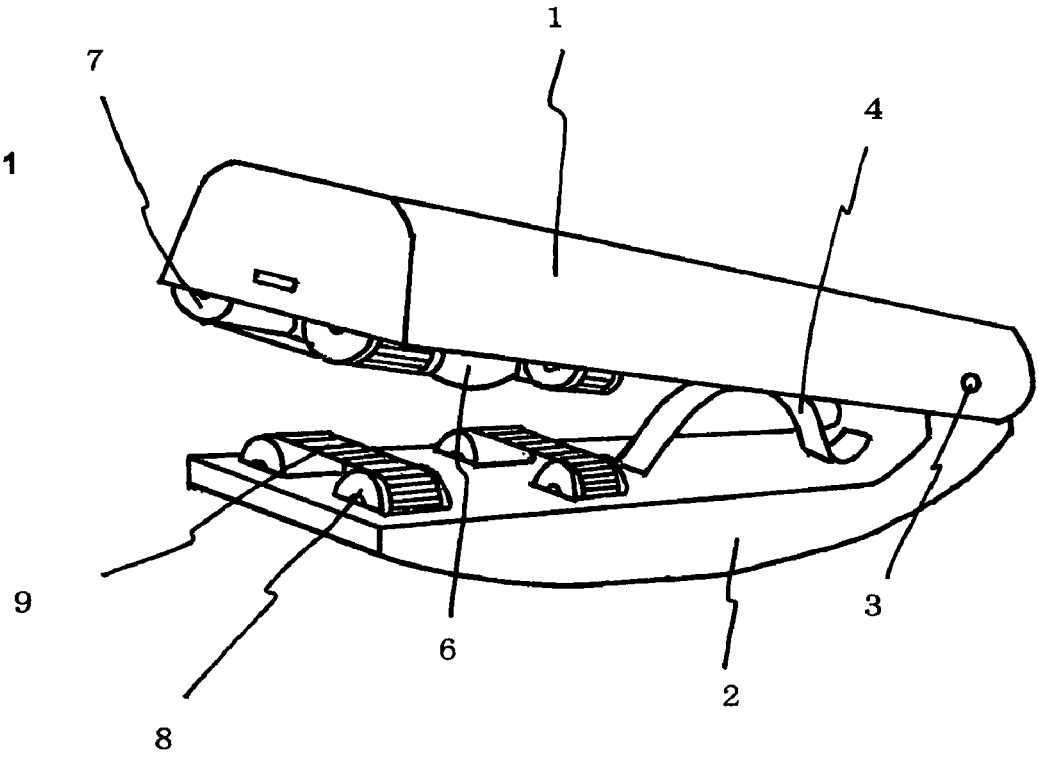
FIG. 1 shows a perspective view of a gluing device embodying said invention.

Therefore, as shown in FIG. 1, said invention has a design that said lower handle 2 is arch while said upper handle 1 is flat so that it is difficult for user to store said invention with said lower handle 2 bottom.

When liquid glue is empty, said glue container 5 can be replaced by unlocking said clasp 11 and opening said plate 12.

Exceptionally, in case of gluing said position longer than handle's length, open said upper handle 1 and lower handle 2 and glue paper using only said upper handle 1 adjusting said gluing pressure by pressing said glue container 5 by finger opening window 17. Also, the lower handle 2 can be designed to be detachable from the upper handle 1.

While preferred embodiments have been shown and described, various modifications and substitutions may be made without departing from said spirit and scope of said invention.

Accordingly, it is to be understood that said present invention has been described by way of example, and not by limitation.

What is claimed is:

1. A table free gluing device comprising:

an upper handle to install a glue container therein;

a glue container containing glue having a gluing part and lid to glue paper therewith;

a plate to hold said glue container cooperating with said upper handle thereby;

a lower handle to hold paper cooperating with said upper handle thereby;

a joint to connect said upper handle, said plate and said lower handle therewith;

two sets of upper rollers with belts which one set consists of two rollers and one belt, and which are put in said plate and two sets of lower rollers with lower belts which are put in a corresponding position to said upper rollers on said lower rollers to grip paper firmly cooperating each other therewith;

a sliding window cooperating with rails to adjust glue pressure mounted to said upper handle thereon;

a sheet shaped spring to press glue cooperating with said upper handle and said lower handle, and to push back said upper handle thereby; and at least one mark on the upper handle to indicate the position of said gluing part thereon.

2. A table free gluing device as defined by claim 1, wherein said glue container is set in said upper handle which said plate is fixed and irremovable.

3. A table free gluing device as defined by claim 1, wherein said glue container contains solid glue having said gluing part and lid to glue paper.

4. A table free gluing device as defined by claim 1, wherein said glue container contains gel glue having said gluing part and lid to glue paper.

5. A table free gluing device as defined by claim 1, wherein said sliding window and rails are set inside of said upper handle.

6. A fable free gluing device as defined by claim 1, wherein said window is open by hinge without rails.

7. A table free gluing device as defined by claim 1, wherein said spring is coil type.

8. A table free gluing device as defined by claim 1, wherein the at least one mark on the upper handle comprises a plurality of marks on said upper handle to indicate the position of said gluing part.

9. A fable free gluing device as defined by claim 1, wherein one set of said upper rollers with said belts which one set consists of two rollers and one belt, which is put either in forehead or rear of said gluing part on said plate and one set of said lower rollers with said belts which is put in said corresponding position to said upper rollers on said lower handle to grip paper firmly cooperating with each other.

10. A table free gluing device as defined by claim 1, wherein two sets of upper rollers with belts which one set consists of one roller and one belt, and which are put in said plate and two sets of lower rollers with lower belts which are put in said corresponding position to said upper rollers on said lower handle to grip paper firmly cooperating with each other.

11. A table free gluing device as defined by claim 1, wherein the belts of the upper and lower rollers are removable and the four upper rollers are operable without belts, each of the four upper rollers being placed in a corner of said gluing part on said plate and four lower rollers are operable without said belts which are put in said corresponding position to said upper rollers on said lower handle to grip paper firmly cooperating with each other.

12. A table free gluing device as defined by claim 1 wherein the belts of the upper and lower rollers are removable and two upper rollers are operable without said belts which are put in forehead and rear of said gluing part on said plate and two lower rollers are operable without said belts which are put in said corresponding position to said upper rollers on said lower handle to grip paper firmly cooperating with each other.

13. A table free gluing device as defined by claim 1 wherein the upper and lower rollers and belts are removable and the upper and lower handles are operable to grip paper firmly cooperating with therebetween.

14. A table free gluing device as defined by claim 1 wherein said lower handle is detachable from said upper handle.

* * * * *